US005287095A

United States Patent [19]

Kitazima et al.

[11] Patent Number: 5,287,095

[45] Date of Patent: Feb. 15, 1994

[54] DISPLAY DEVICE AND ITS DISPLAYING METHOD

[75] Inventors: Masaaki Kitazima, Hitachiohta; Masahiro Eto, Fujisawa; Hiroshi Jitsukata, Yokohama, all of Japan

[73] Assignee: Hitachi, Ltd., Tokyo, Japan

[21] Appl. No.: 803,909

[22] Filed: Dec. 9, 1991

Related U.S. Application Data

[63] Continuation of Ser. No. 446,300, Dec. 5, 1989, abandoned.

[30] Foreign Application Priority Data

Dec. 9, 1988 [JP] Japan ..... 63-310029

[51] Int. Cl.[5] ..... G09G 3/36

[52] U.S. Cl. ..... 345/99; 345/208

[58] Field of Search ..... 340/718, 719, 784, 805, 340/793, 800; 358/241, 236; 359/55, 54, 57, 58

[56] References Cited

U.S. PATENT DOCUMENTS

| | | | |
|---|---|---|---|
| 4,766,430 | 8/1988 | Gillette et al. | 340/784 |
| 4,804,951 | 2/1989 | Yamashita et al. | 340/784 |
| 4,825,202 | 4/1989 | Dijon et al. | 340/784 |
| 4,840,462 | 6/1989 | Hartmann | 340/784 |
| 4,931,787 | 6/1990 | Shannon | 340/784 |
| 5,091,722 | 2/1992 | Kitajima et al. | 340/805 |

FOREIGN PATENT DOCUMENTS 60-3698 1/1985 Japan .

*Primary Examiner*—Alvin E. Oberley
*Assistant Examiner*—Regina Liang
*Attorney, Agent, or Firm*—Kenyon & Kenyon

[57] ABSTRACT

A display device suitable for a high speed operation liquid crystal display device includes a matrix circuit having a plurality of signal lines, scanning lines disposed so as to intersect the signal lines and pixels provided at the positions corresponding to the intersections of the signal lines and the scanning lines; and a switching circuit for incorporating picture signals provided in correspondance to the signal lines, wherein the adjacent switching circuits are both turned on simultaneously.

17 Claims, 14 Drawing Sheets

DISPLAY DEVICE AND ITS DISPLAYING METHOD

This application is a continuation of application Ser. No. 07/446,300, filed Dec. 5, 1989, now abandoned.

BACKGROUND OF THE INVENTION

The present invention relates to a display device and a display method, and in particular to, a display device which operates at high-speed suitable for a liquid crystal display device, and its displaying method.

Conventional liquid crystal display units are discussed in Japanese Patent Application Laid-Open No. 60-3698 (1985).

A control signal which controls the switching element which incorporates the display (picture) signal, has hitherto been generated in sequence. Thus the control signal shifted from a low (L) level to a high (H) level for every incorporation of the picture signal and further shifted to the three stages of the L level.

In the prior art, supplying the picture signal to each picture element which constitutes the display at high speed is necessary, particularly accompanying the development of a high resolution display. Therefore, of the peripheral circuits, the acquisition time of the picture signal must be high-speed.

Further, constructing the peripheral circuits of the display using the same or similar thin film elements as used in the picture element or pixel area, and having them built-in on the substrate of the display for miniaturization and high functionality is required.

Therefore it is necessary to carry out the above incorporation of the picture signals at high speed, using circuits with thin film elements. However, because the wave distortion of the signal is large for the circuits using thin film elements such as the TFT (Thin Film Transistor), and because incorporating the picture signals at high speed is difficult, realizing a high resolution display was difficult.

SUMMARY OF THE INVENTION

The present invention provides a high resolution display device and a display method.

Further, the present invention provides a display device which build-in peripheral circuits constructed with thin film elements, incorporates picture signals at high speed, and carries out picture display and its display method using such a device.

A feature of the present invention is attained by reducing the number of shifts of the level of the control signals for incorporating picture signals.

In concrete terms, the display device and its displaying method comprise at least a matrix circuit which includes signal conductors of a plurality of rows, and scanning lines set up to cross the signal conductors, and picture elements provided at the position corresponding to the points of intersection of the signal conductors and the scanning lines, and a switch circuit (also called a voltage switching circuit) provided corresponding to the signal conductors and for incorporation of picture signals, and is constructed to turn on the adjacent congenial switch circuits substantially simultaneously.

Further, another feature of the present invention is the use of thin film elements such as TFT, as a component to construct the switch circuits.

Also, the number of control signal level shifts is minimized by simultaneously turning on all of the switch circuits.

A case where all of the switch circuits are turned on simultaneously will be explained as an example.

On starting the sampling, all of the control signals for incorporating picture signals are set to one state. Next for every timing of the sampling of the picture signal, it is rendered to the other state. Therefore, because the number of control signal level shifts is minimized the decrease of the sampling speed due to wave distortion is prevented.

Therefore, according to the present invention, the decrease of the sampling speed is prevented even when using an element causing a large wave form distortion, such as the thin film component, and high speed sampling is realized, and a high resolution display is achieved.

Objects, features, functions other than the ones explained above, of the present invention will be apparent from the following description.

BRIEF DESCRIPTION OF DRAWINGS

The present invention will be more apparent from the following detailed description, when taken in conjunction with the accompanying drawings, in which.

DETAILED DESCRIPTION

Embodiments of the present invention will be explained in the following with diagrams. The identical element names or numbers used in each diagram show the identical or corresponding items.

Figure 1:
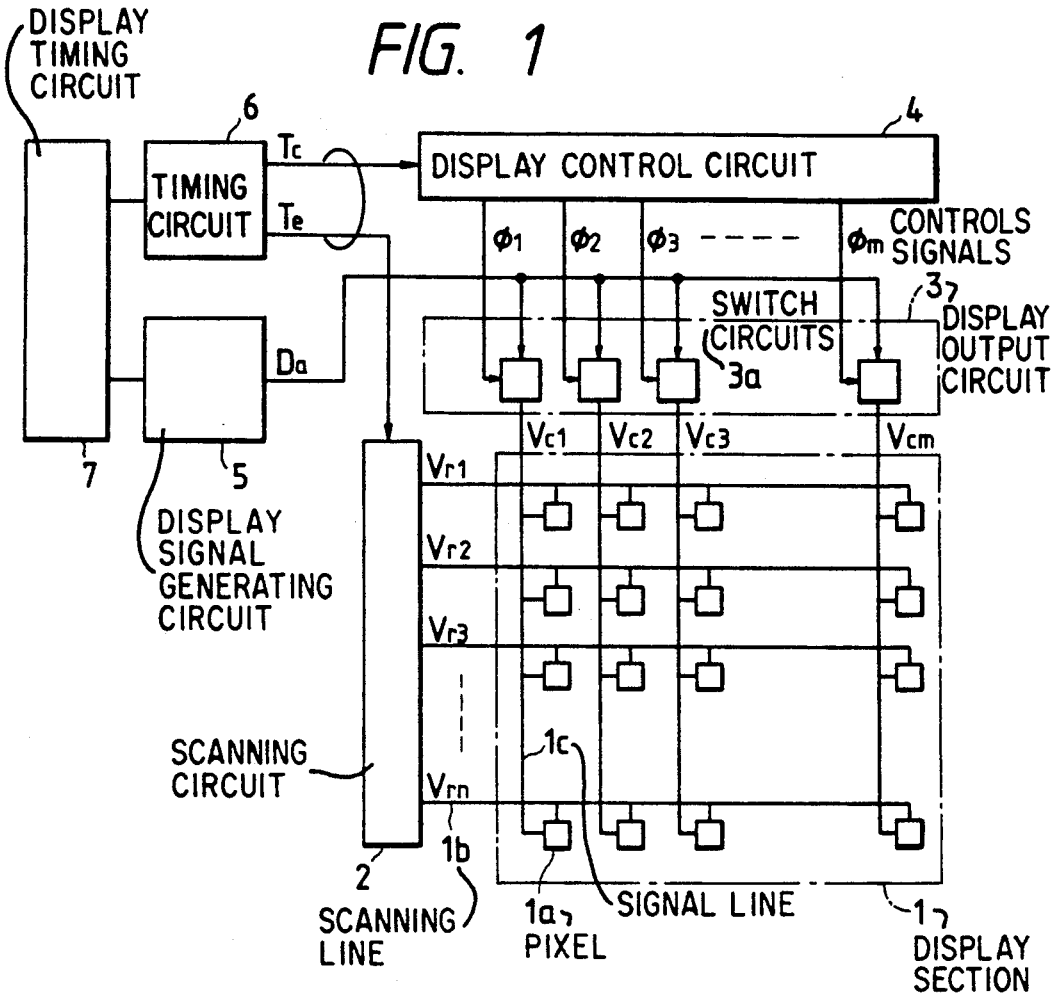
FIG. 1 shows an embodiment of a display device according to the present invention.

FIG. 1 shows an example constitution of a display unit according to the present invention. Display section 1 is constructed with pixels 1*a* arranged in X, Y matrix form, and scanning lines 1*b* and signal lines 1*c* for driving the pixels 1*a*. The pixel 1*a* is set up in a position corresponding to the point of intersection of the scanning line 1*b* and the signal line 1*c*. Signal voltages $V_{c1} \sim V_{cm}$ are applied to the signal conductor 1*c*, but the voltages are generated from a display signal output circuit 3 which uses a plurarity of switch circuits 3*a*. Also, each of the switch circuits 3*a* is controlled by a respective one of control signals $\phi_1 \sim \phi_m$ from a display control circuit 4.

Scanning signals $V_{r1} \sim V_{rn}$ are signals for driving the pixels 1*a* in sequence according to the lines, and the scanning signals $V_{r1} \sim V_{rn}$ are generated in a scanning circuit 2.

A timing circuit 6 generates timing signals Tc and Te for operating the display control circuit 4 and the scanning circuit 2 respectively. Further, a display signal generating circuit 5 generates a display information signal Da displayed at the pixel 1*a*.

Also, a display timing circuit 7 controls the operation of the entire display unit.

Figure 2A:
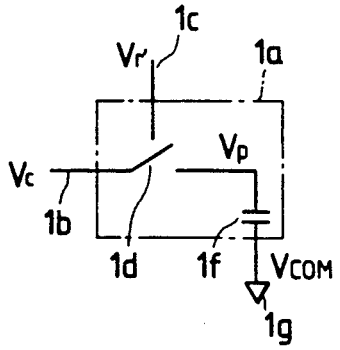
FIGS. 2*a* and 2*b* shows an example construction of the picture elements in the display device of FIG. 1.
Figure 2B:
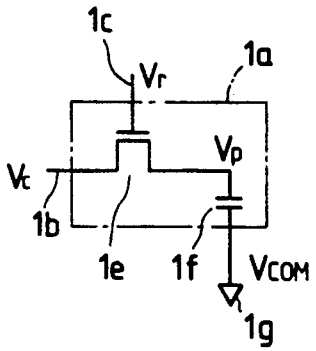

FIGS. 2*a* and 2*b* show construction examples of the pixel 1*a* at a position corresponding to the point of intersection of the scanning line 1*b* and the signal line 1*c*.

FIG. 2(*a*) shows a general construction example, constructed with an electronic switch 1*d* and a liquid crystal 1*f* represented by a capacitor. Also, FIG. 2(*a*) shows a more concrete construction example, in which the electronic switch 1*d* shown in FIG. 2(*a*) is constituted with a TFT (Thin Film Transistor) 1*e* which is a thin film component. Scanning signal Vr is applied to the control terminal (gate terminal) of the TFT, and signal voltage Vc is applied to one of the source-drain of the TFT and drives the liquid crystals 1*f* connected to the other of the source-drain of the TFT. The other terminal 1*g* of the liquid crystal 1*f* is connected to a common voltage (Vcom).

In FIGS. 2*a* and 2*b*, the electronic switch 1*d* or the TFT 1*e* performs an ON-OFF function by means of scanning signal Vr, and drives the liquid crystal 1*f*.

Figure 3:
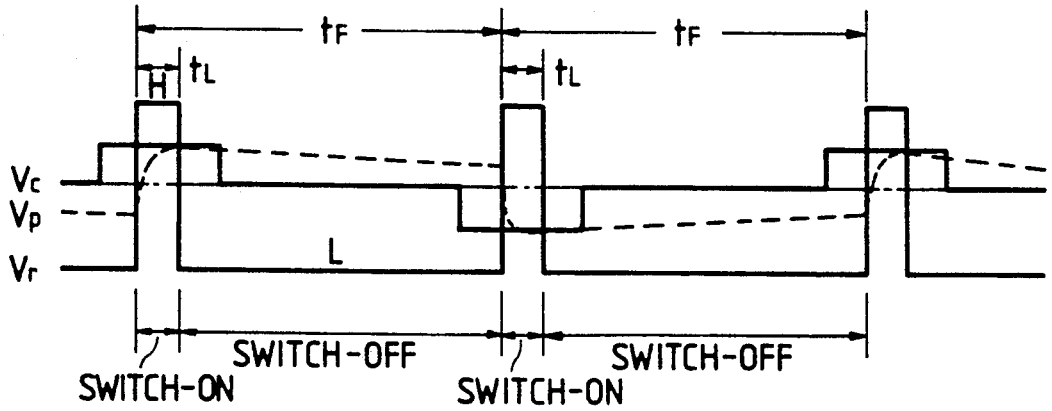
FIG. 3 shows an example operation of the display device of FIG. 1.

An example operation of this moment is shown in FIG. 3. When the scanning signal Vr becomes H, the electronic switch 1*d* or the TFT 1*e* turns into ON state, which results in one of the terminal voltages Vp of the liquid crystal 1*f* reaching the level of display signal Vc, as shown by the dotted line.

Also, when the scanning signal Vr returns to the L level, the electronic switch 1*d* or the TFT return to the OFF state, and Vp is maintained with no substantial change, as shown by the dotted line.

Figure 4:
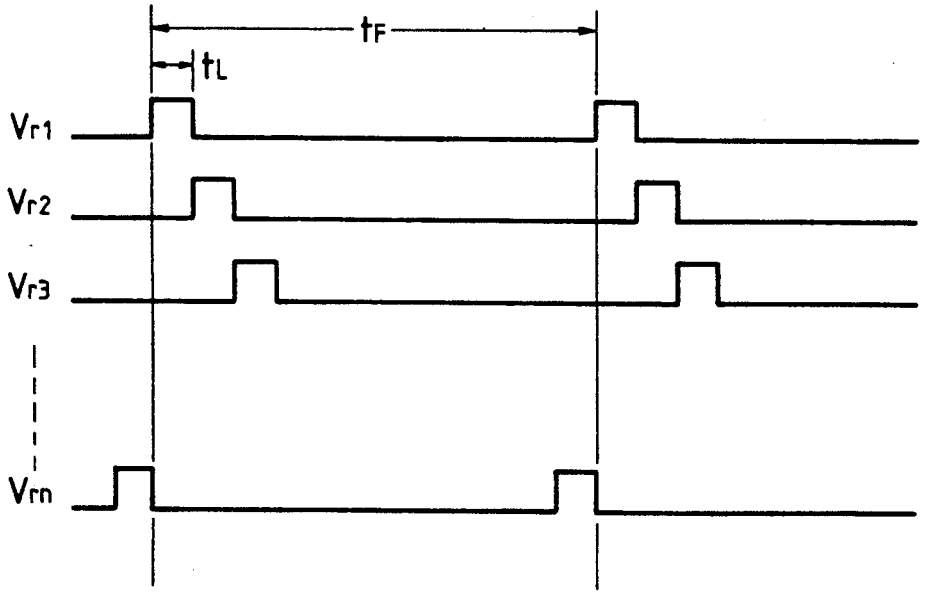
FIG. 4 shows the timing of the scanning signals in FIG. 1.

FIG. 4 shows the timing of the scanning signal Vr which comprises gate voltage (scanning voltage) wave forms applied to the pixels and the TFT during sequential drive according to the lines. Time $t_L$ is the time period for selecting one scanning line. On the other hand, time $t_F$ is the scanning time of one screen, wherein $t_F = n \cdot t_L$ (n is the number of scanning lines).

The voltage applied to liquid crystal 1*f* is the voltage difference Vp−Vcom (i.e., the voltage) between voltage Vp and the applied voltage of terminal 1*g*. The brightness of the picture element is determined by the strength of this voltage.

Figure 5A:
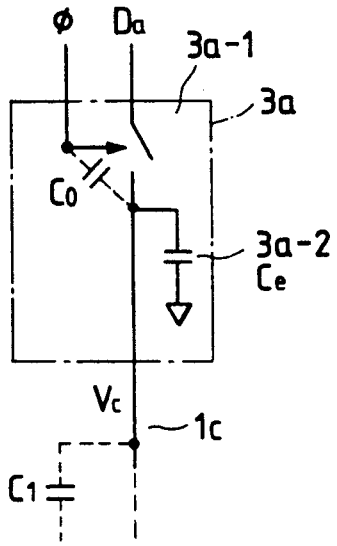
FIGS. 5*a*–5*e* show an example construction of the switch circuit in FIG. 1.
Figure 5B:
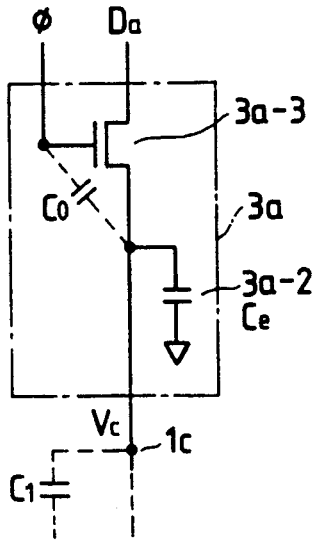
Figure 5C:
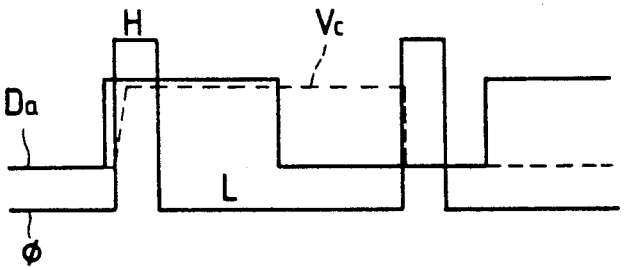
Figure 5D:
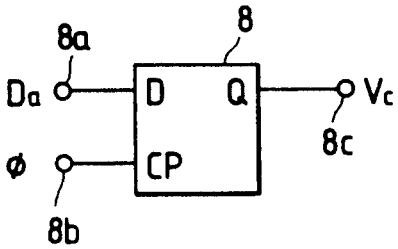
Figure 5E:
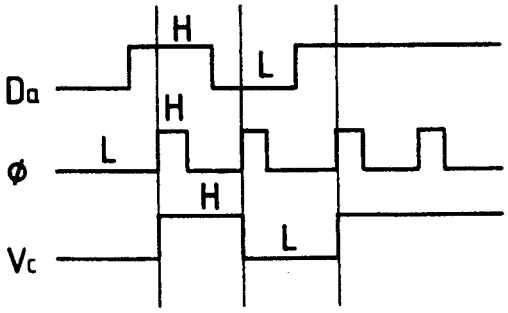

Next, an example construction of the display signal output circuit 3 is explained. FIGS. 5*a* and 5*b* show example constructions of a switch circuit 3*a* which constructs the display signal output circuit 3. FIG. 5(*a*) shows a general example construction of the switch circuit 3*a*, and is constructed with an electronic switch 3*a*-1 and a capacitor 3*a*-2. FIG. 5(*b*) is a more specific diagram related to FIG. 5(*a*), and is constructed with a TFT 3*a*-3 and a capacitor 3*a*-2. By inputting control signal $\phi$ of the display control circuit 4 to the gate electrode of the TFT 3*a*-3, ON-OFF switching is carried out, and the output of the pixel information signal Da is controlled.

FIG. 5(*c*) shows the operation of the circuit. When the control signal $\phi$ becomes H, it incorporates the pixel information signal $D_a$, and when it becomes L, it maintains the signal $D_a$ as in $V_e$, shown by the dotted line.

Further, capacitance Ce of the capacitor 3*a*-2, shown in the circuit shown in FIG. 5(*a*) and FIG. 5(*b*) is made to satisfy the condition below.

$$C_1 + C_f \gtrsim C_o \quad (1)$$

In equation (1), $C_f$ is the stray capacitance for every one signal line, and $C_o$ is the coupling capacitance between the control signal ($\phi$) line and the signal line 1*c* (output line). Further, where the TFT 3*a*-3 is used as in FIG. 5(*b*), $C_f$ is approximately equal to the gate capacitance of the TFT 3*a*-3.

The condition of equation (1) is a condition where the output voltage $V_c$ of the display signal output circuit 3 is hardly affected by the control signal $\phi$, and a homogeneous brightness is obtained.

Also, in the case where $C_f$ is sufficiently large, it is not absolutely necessary to use the capacitor $C_e$.

FIG. 5(*d*) shows another example of the switch circuit construction. The electronic switch circuit is replaced with a latch circuit 8 including a data input terminal 8*a*, input clock terminal 8*b* and a data output terminal 8*c*. An example operation of this is shown in FIG. 5(*e*). In this case, pixel information signal Da inverts the polarity (H or L) for every one frame, so as to drive the liquid crystal with A.C.

Next, an embodiment of the display control circuit 4, which generates the control signals $\phi_1 \sim \phi_m$, is explained.

Figure 6:
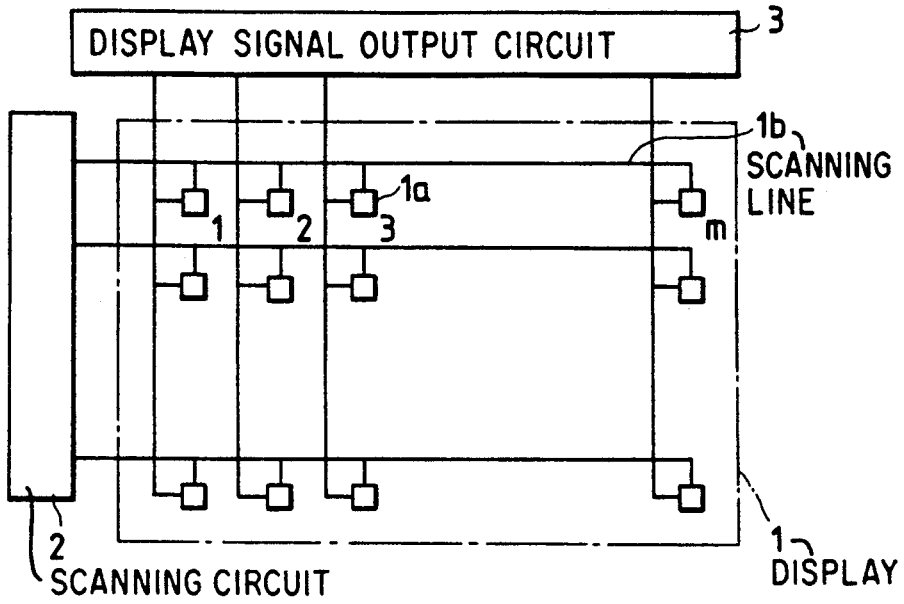
FIG. 6 shows an example arrangement of the picture elements in one embodiment according to the present invention.
Figure 7:
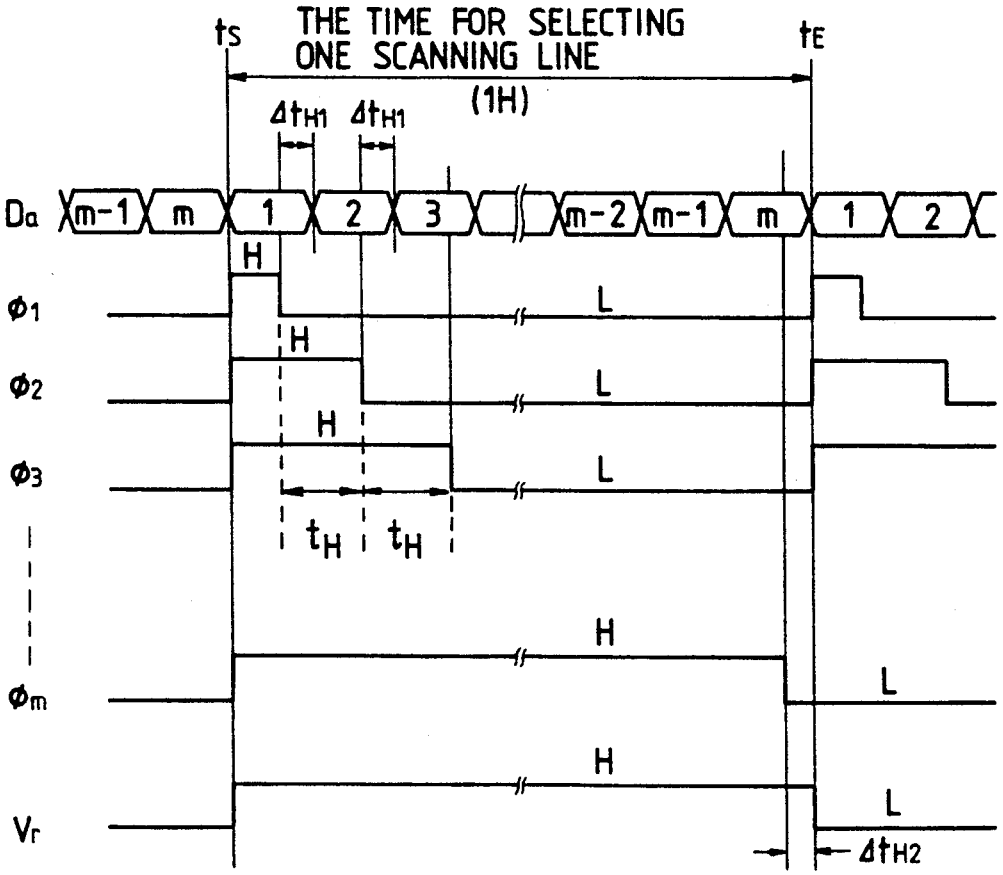
FIG. 7 shows the timing of the picture element information signal, the control signal and the scanning signal in the case of FIG. 6.

FIG. 6 shows an example arrangement of pixels for explaining the embodiment. The pixels 1*a*, connected to the scanning line 1*b*, are given the numbers 1, 2, 3, . . . , m starting from the side near the scanning circuit 2. The timing of the pixel information signal Da with the control signals $\phi_1 \sim \phi_m$ and the scanning signal Vr is shown in FIG. 7. The numbers assigned to the pixel information signal Da correspond to pixels 1*a* which were numbered in FIG. 6.

The control signals $\phi_1 \sim \phi_m$ become H level at time ts, and later change to L level, in order starting from $\phi_1$. The timing of the change from H level to L level is before the pixel information signal Da shifts from 1 to 2, 2 to 3, and so on ($\Delta t_{H1} \gtrsim 0$). $\Delta t_{H1}$ is the amount of the margin for incorporating Da (because the trailing edge of the $\phi$ signal becomes blunted).

The pixel information signals Da, immediately before the control signals $\phi_1 \sim \phi_m$ changes from H level to L level, are incorporated to the respective switch circuits 3a and are outputted (=Vc).

Also, the timing of the change of the scanning signal Vr from H level to L level is at $\Delta t_{H2}$ ($\Delta t_{H2} \gtrsim 0$) after $\phi_m$ changes from H level to L level. $\Delta t_{H2}$ is the amount of the margin for the data to be completely written into the pixel 1a (Because the trailing edge of scanning signal Vr becomes blunted)

The operation stated above is a line period, and this operation is likewise carried out for the frame period.

Further, the scanning signal Vr does not necessarily have to be made from H level to L level at time $t_s$, and may be made to H level for only the period $\Delta t_{H2}$ immediately before time $t_e$.

FIG. 7 also shows the state where the switch circuit 3a is turned ON-OFF according to the control signals $\phi_1 \sim \phi_m$. Adjacent switch circuits 3a are substantially simultaneously turned ON. Also, all of the switch circuits 3a are simultaneously turned on.

Figure 8:
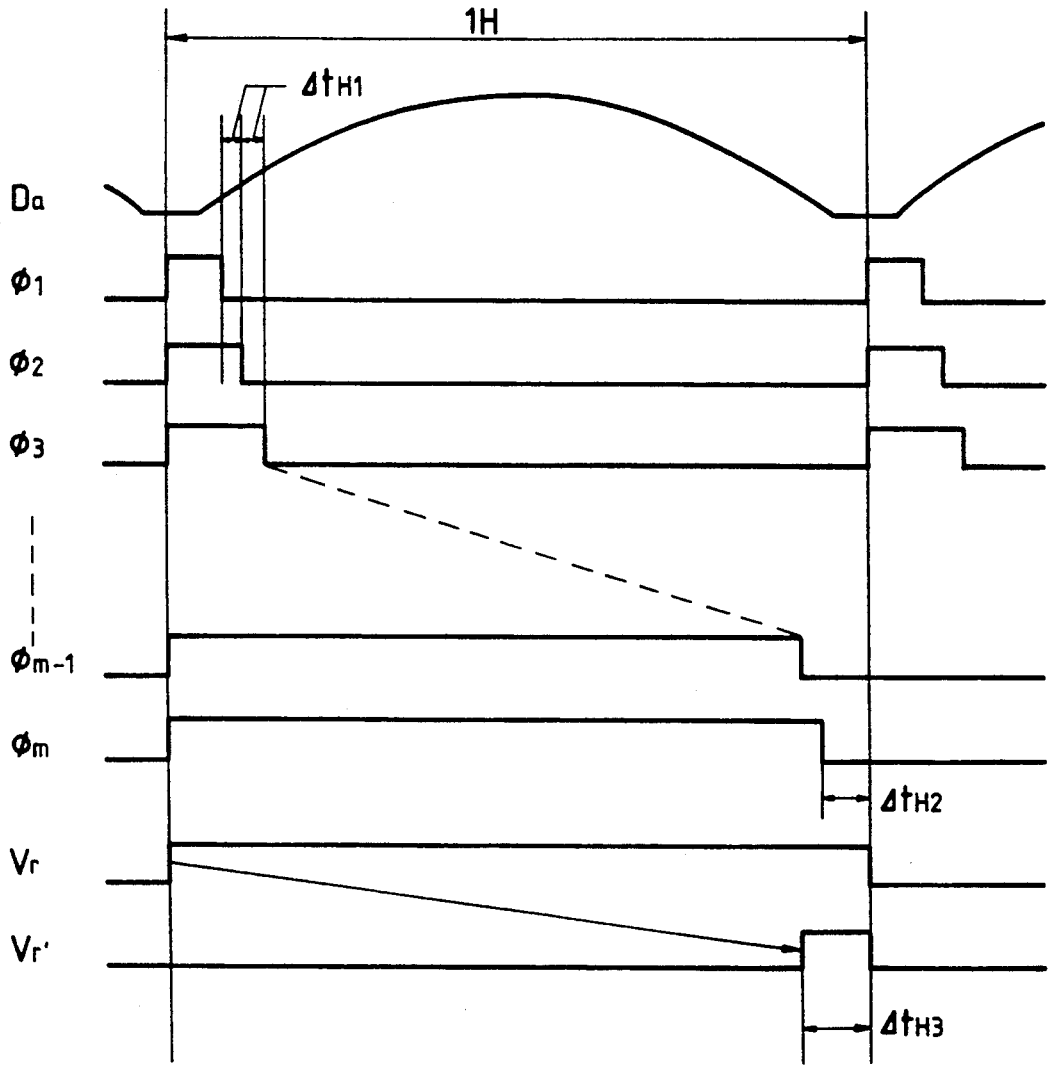
FIG. 8 shows an example timing of when the picture element information signal, which shifts in an analog fashion is incorporated.

FIG. 8 shows an example timing of when the pixel information signal Da, which changes in an analog (0) rather than digital fashion, is incorporated. In this case, the waveform of the scanning signal may be either Vr or Vr'. However, it is necessary to satisfy the condition of $\Delta t_{H2}$, $\Delta t_{H3} > 0$. As shown in FIG. 8, the control signals of $\phi_1 \sim \phi_m$ are substantially simultaneously turned ON (to become H level) and are turned OFF at a shifted timing of $\Delta t_{H1}$ (to become L level).

Figure 9:
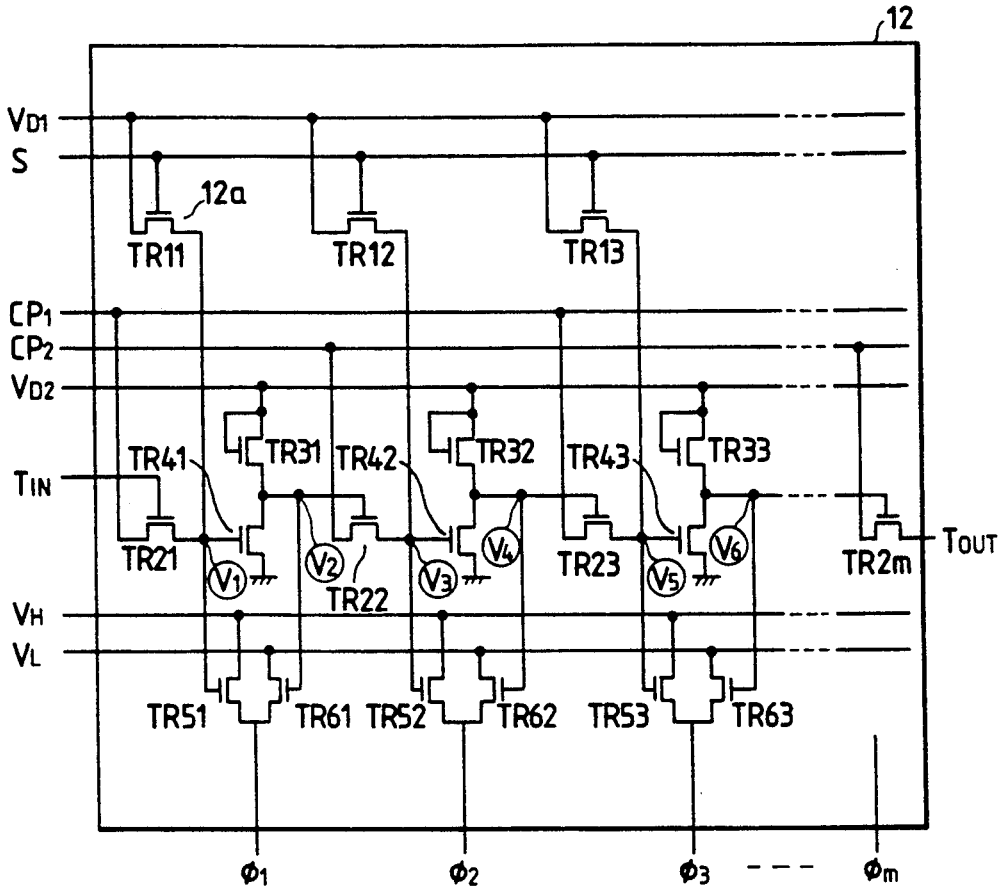
FIG. 9 shows an embodiment of a display control circuit.

FIG. 9 shows an embodiment of a display control circuit. The first stage circuit that outputs the control signal $\phi_1$ of a display control circuit, is constructed with six transistors, TR11, TR21, TR31, TR41, TR51, and TR61.

An inverter circuit is constructed with TR31 and TR41, and the other transistors act as switch components.

Signal S is applied to the gate terminal of the transistor TR11, and controls the output of signal $V_{D1}$. Signal CP1 is applied to the transistor TR21 and is controlled by signal $T_{IN}$, applied to the gate terminal of TR21. The outputs of the transistors TR11 and TR21 are applied to the gate terminals of the transistors TR41 and TR51. Signal $V_{D2}$ is applied to one of the terminals and the gate terminal of the transistor TR31. The other terminal of the transistor TR31 is connected to the terminal of the transistor TR41 not grounded, and output $V_2$ from that midpoint is applied to the gate terminal of a second stage transistor TR22, and controls the ON-OFF of signal $CP_2$. Also the output $V_2$ is applied to the gate terminal of the transistor TR61. And the output of signal $V_L$ to the signal lines is controlled by the transistor TR61.

Also, the circuits beyond the second stage which output the control signals $\phi_2 \sim \phi_m$ are also the identical circuits, and these circuits are provided as the same number as that of the signal lines. Further, each transistor may be a MOSFET, but when constructed with a TFT, it is possible to integrate them with the display part, which is convenient for the construction of the device.

Figure 10:
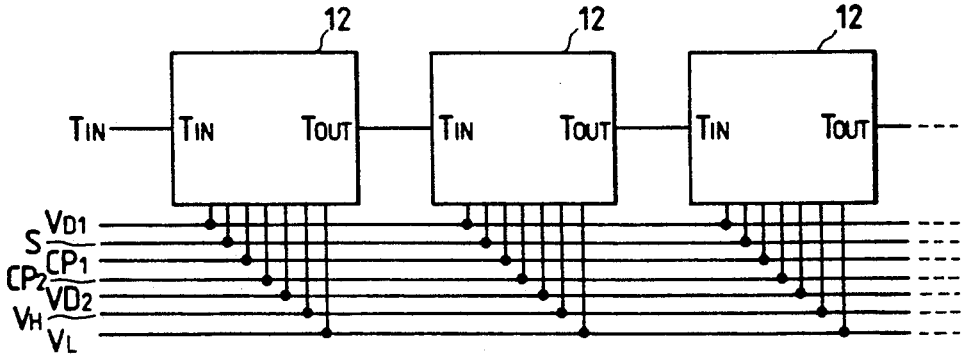
FIG. 10 shows an example construction of a cascade connection of the circuit in FIG. 9.

FIG. 10 shows an example construction of a display control circuit where the circuit 12, shown in FIG. 9, is connected in cascade.

Figure 11:
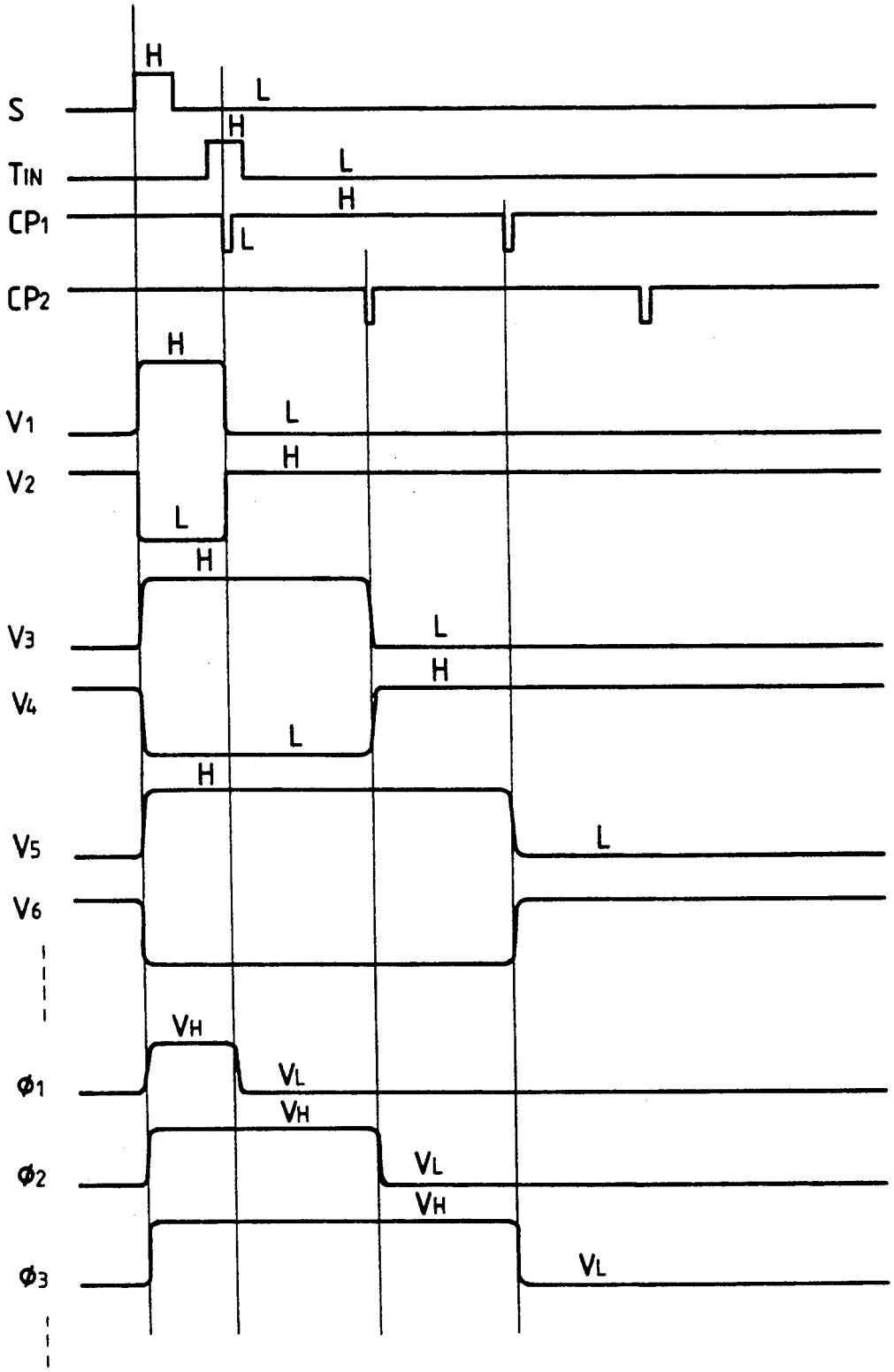
FIG. 11 shows the timing chart showing the operation of the circuit in FIG. 9.

FIG. 11 is a timing chart that shows the operation of the circuit shown in FIG. 9. By means of signal S, $V_1$, $V_3$, $V_5$ . . . becomes H level ($\lesssim V_{D1}$), on the other hand $V_2$, $V_4$, $V_6$ . . . becomes L level. Next, when signal $CP_1$ is applied when the signal $T_{IN}$ is in H level, $V_1$ becomes L level (GND), thereafter every time $CP_2$ or $CP_1$ becomes L level, $V_3$, $V_5$ . . . becomes L level in consecutive order.

As a result, $\phi_1 \sim \phi_m$ change from $V_H$ to $V_L$ in consecutive order. Further, $V_{D1}$ and $V_{D2}$ are constant voltages. Also, there should be no special restrictions for the electric potentials of S, $CP_1$, $CP_2$, $TI_N$, $VD_1$, $VD_2$, $V_H$, $V_L$ and GND. Further, each transistor shown in the diagrams is an n-type TFT, but a P-type TFT, is also appropriate.

Figure 12:
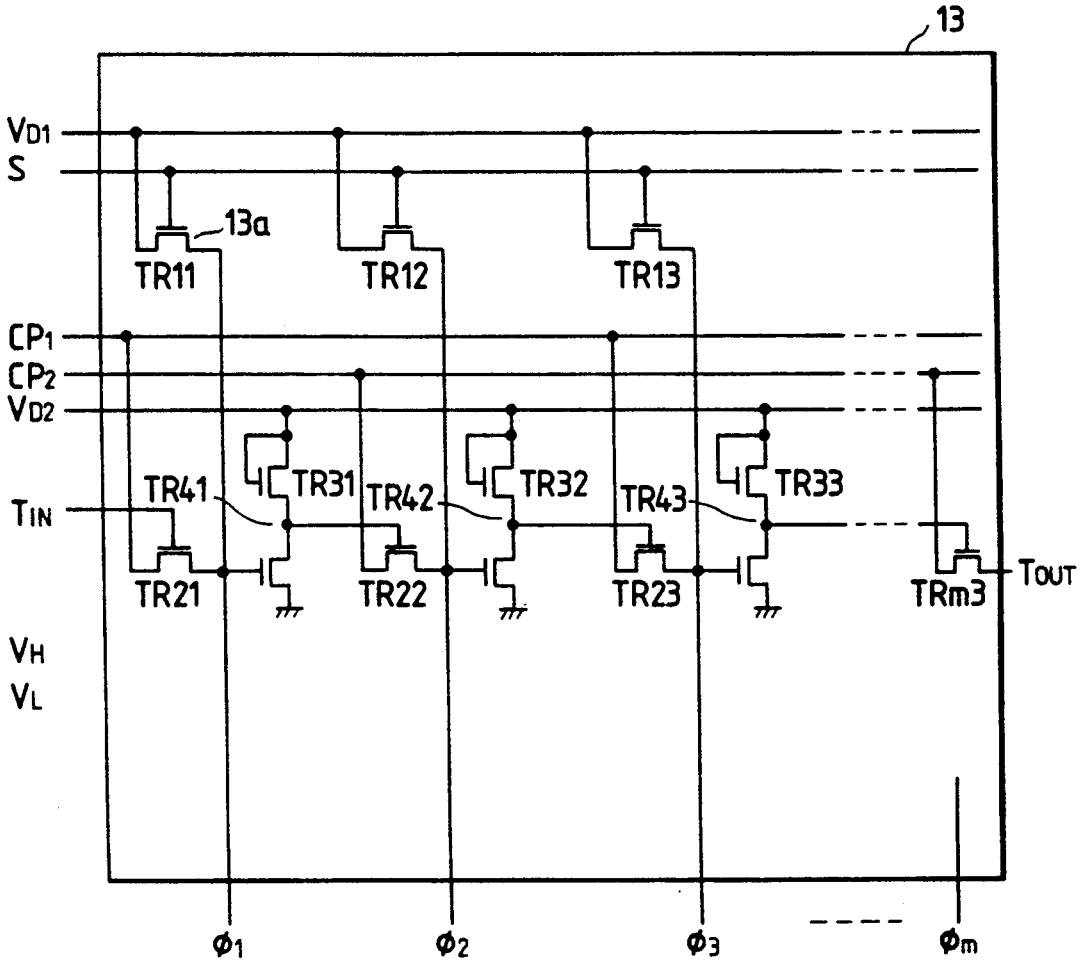
FIG. 12 shows another embodiment of the present invention.

FIG. 12 shows another example of the display control circuit.

Figure 13:
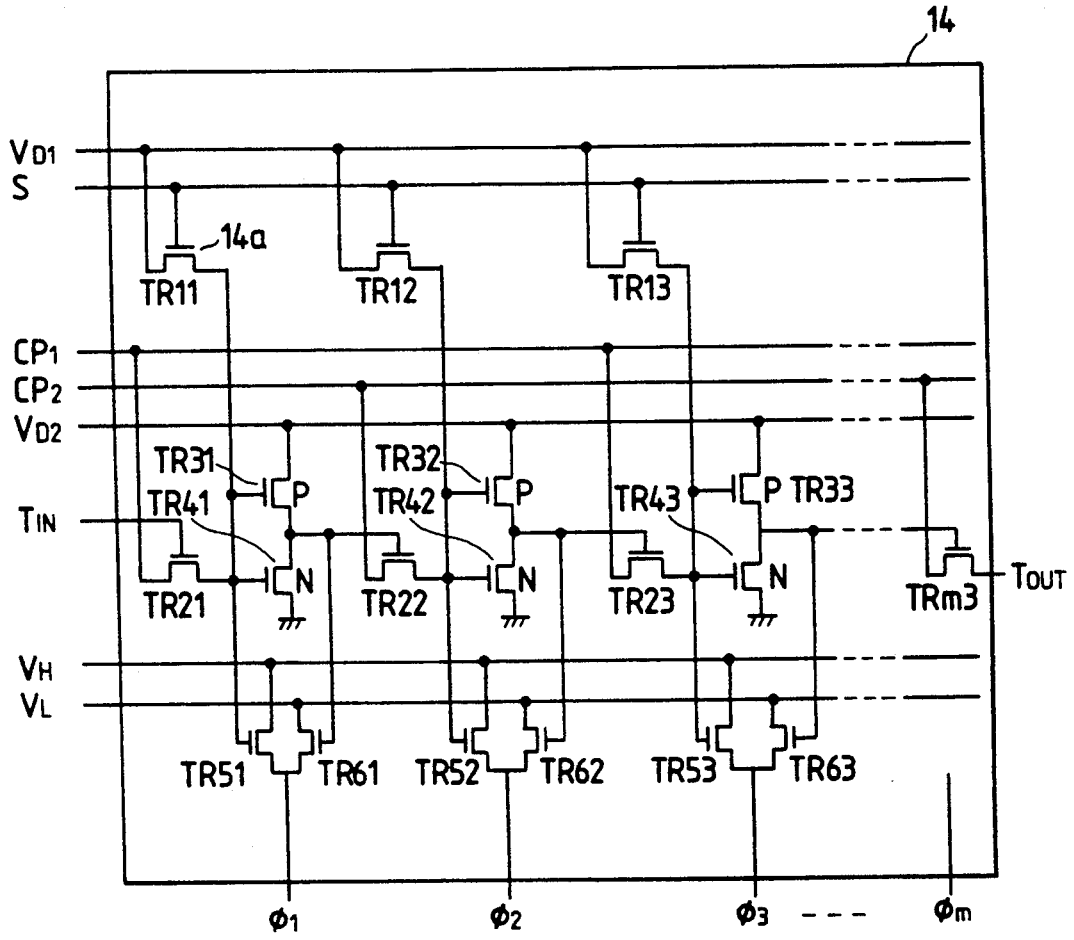
FIG. 13 shows modified exemplary circuit of FIG. 12.

This example differs from the embodiment of FIG. 9, since the transistor TR51 and the transistor TR61 are excluded (using the First stage as an example). Thus, either $V_{D1}$ or $CP_1$ is outputted as the control signal $\phi_2$. Also, FIG. 13 is an example where the inverter circuits constructed with TR31 and TR41, TR32 and TR42, TR33 and TR43 . . . of FIG. 9 are constructed with C-MOS circuits formed from a P-type and a N-type. When constructed with C-MOS circuits, power consumption reduction is possible. Also since a high-speed operation is realized, it is preferable for the display apparatus to have built-in peripheral circuits, which integrates the display portion and the display control circuits.

Figure 14:
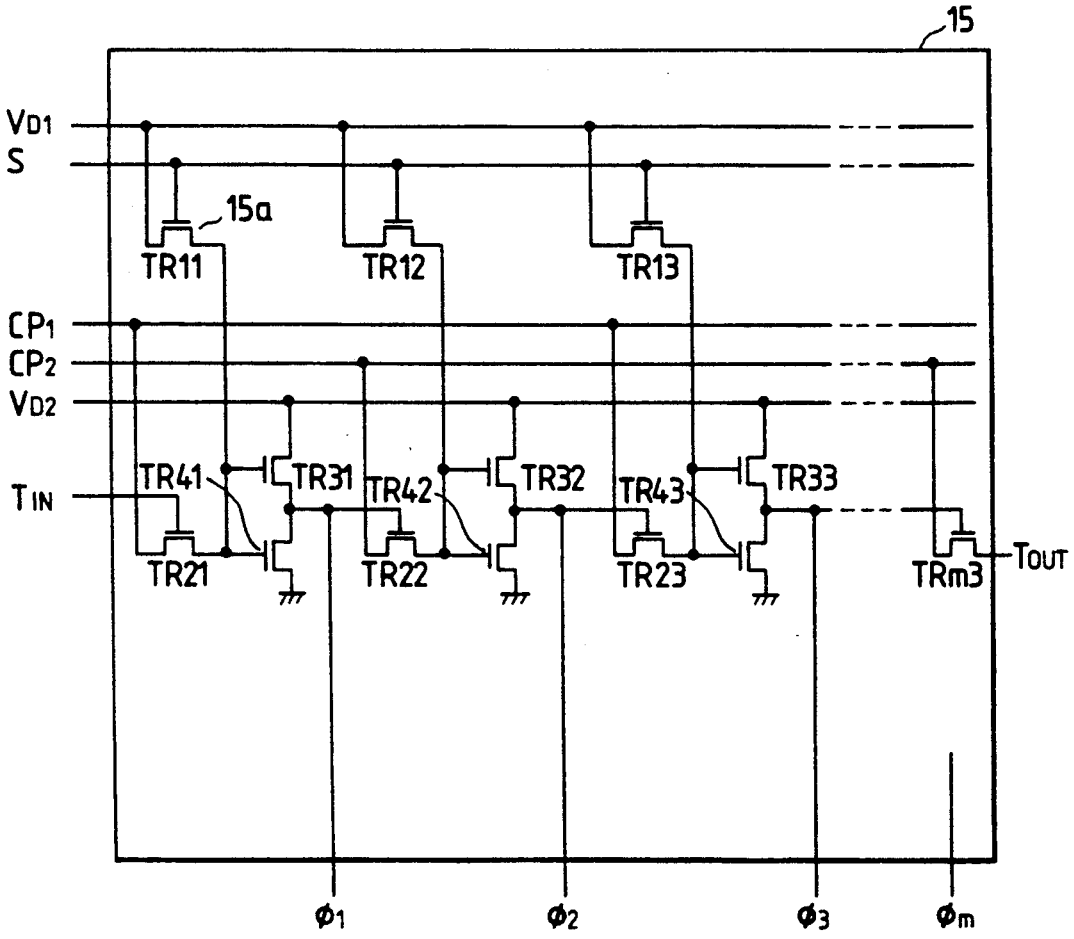
FIG. 14 shows another modified exemplary circuit of FIG. 12.

FIG. 14 is still another example of the circuit.

The difference from FIG. 12, (using the first stage as an example), is that the control signal $\phi_1$ is the output of an inverter formed with the transistors TR31 and TR41.

There may be constructions by means of various measures other than the circuits stated above, as long as the control signals $\phi_1 \sim \phi_m$ shown in FIG. 7 and FIG. 8 are obtained. Thus there are no special restrictions for the construction.

Figure 15:
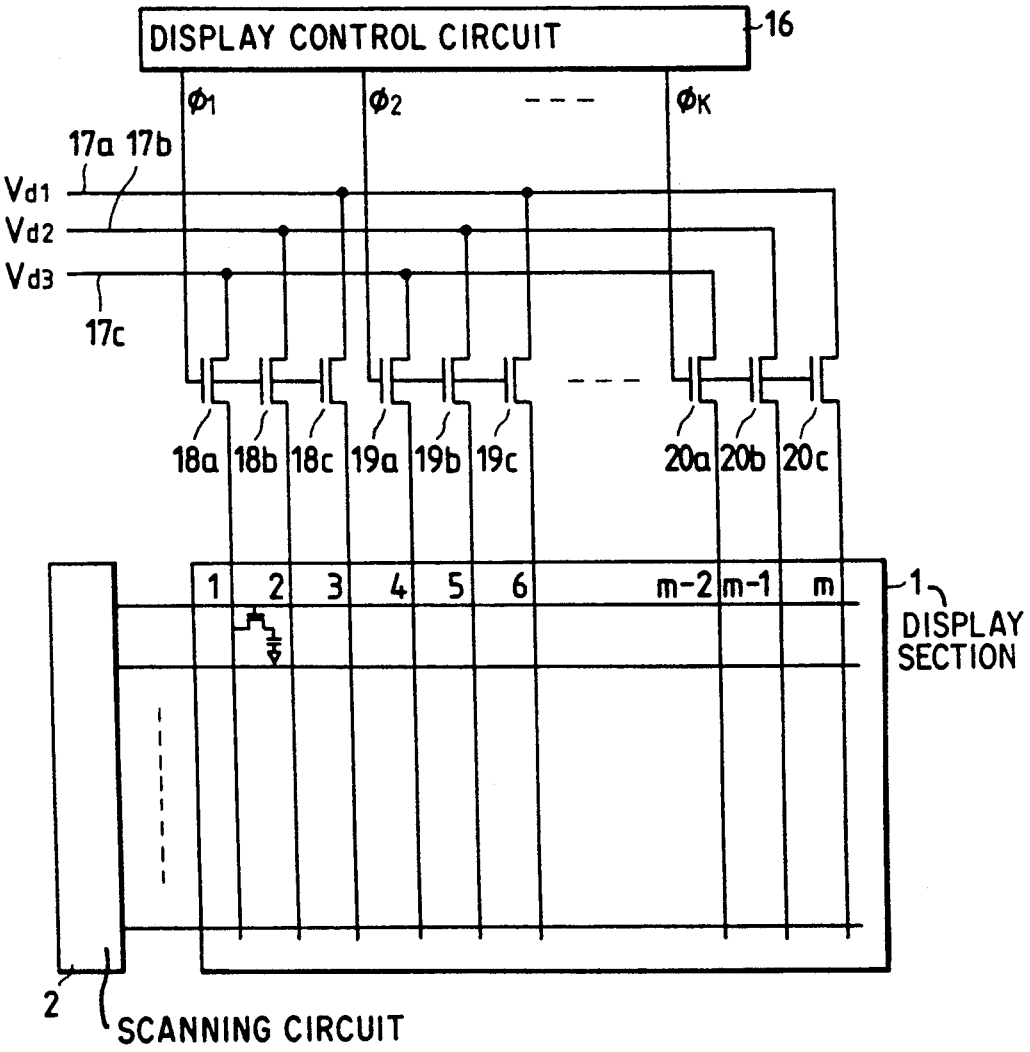
FIG. 15 shows still another embodiment of the present invention.

FIG. 15 shows an example construction of a display apparatus using a display control circuit 16 according to the present invention.

The pixel information signal is divided into three parts, $Vd_1$, $Vd_2$, and $Vd_3$, and are added to information signal lines 17a, 17b, and 17c.

The switch circuit incorporates the signals $V_{d1}$, $V_{d2}$, and $V_{d3}$ to each group of the three transistors 18a, 18b, 18c, 19a 19b, 19c, . . . .

In this example construction, when the number of horizontal picture elements is m, the number of control signals K becomes K=m/3. Therefore, because making the operation of the display control circuit 16 more low-speed is possible, such a construction is convenient especially for a circuit constructed with a low-speed operating transistors.

Figure 16:
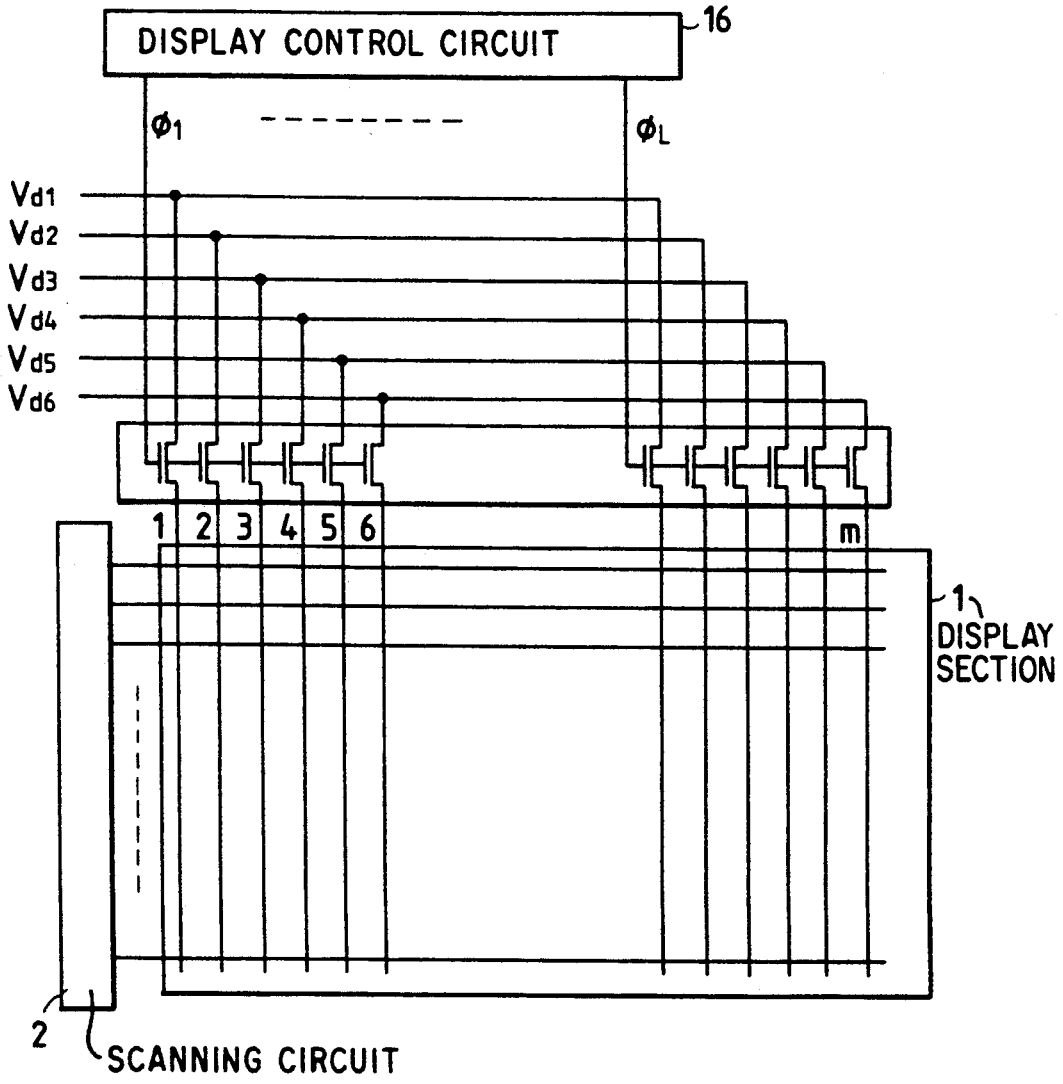
FIG. 16 shows modified exemplary display device of FIG. 15.

FIG. 16 is modified example of FIG. 15. Thus, by increasing the number of divisions of the pixel information signal (in FIG. 15 the number of divisions is 3, in FIG. 16 the number of divisions is 6), the operation of the display control circuit may be made low-speed.

Figure 17:
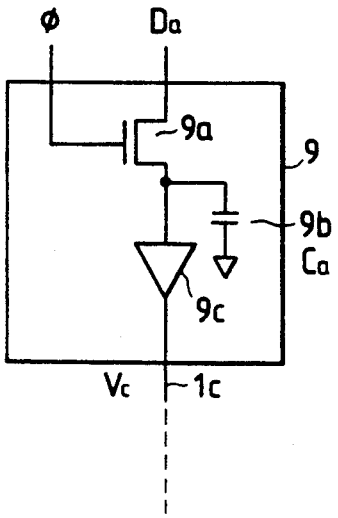
FIG. 17 shows modified exemplary switch circuit shown in FIG. 1.

FIG. 17 is a modified example of the switch circuit 3a shown in FIG. 1. Switch circuit 9 is constructed with a TFT 9a, a capacitor 9b and a buffer amplifier 9c. By adding the buffer amplifier 9c the fluctuation of signal voltage Vc is reduced, and a homogeneous display is realized.

Figure 18A:
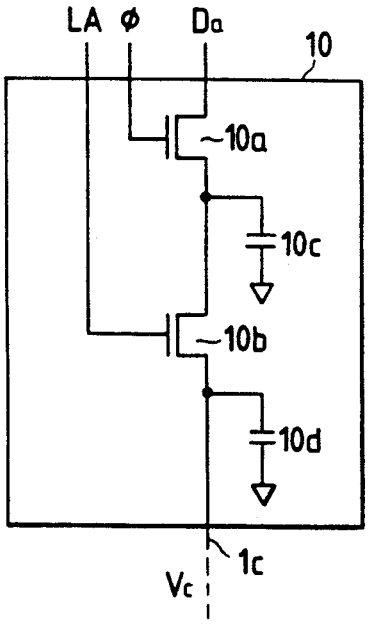
FIGS. 18*a*–18*b* show a modifications of FIG. 17.
Figure 18B:
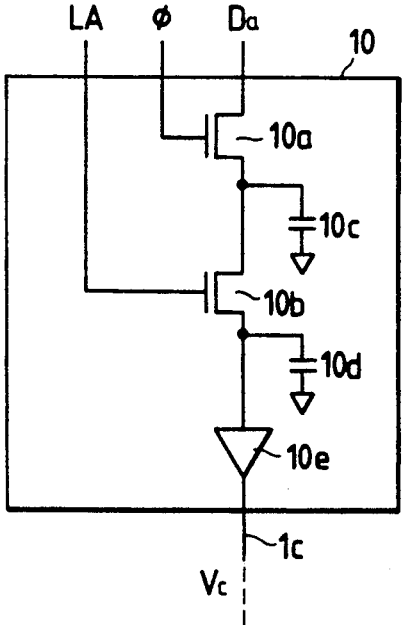

Also, FIGS. 18(*a*) and 18(*b*) show other embodiments of the circuit switch. The pixel information signal Da is incorporated, based on the control signal $\phi$, by a TFT 10a and a capacitor 10c shown in FIG. 18(*a*) Also this signal is transferred to the capacitor by a LA signal through the aid of the TFT 10*b*.

FIG. 18(*b*) is modified example of FIG. 18(*a*), wherein a buffer amplifier 10*e* is added. The effect of adding the buffer amplifer 10*e* is the same as FIG. 17, (i.e., it allows the fluctuation of the signal voltage Vc to be reduced and allows a homogeneous display to be realized).

Figure 19:
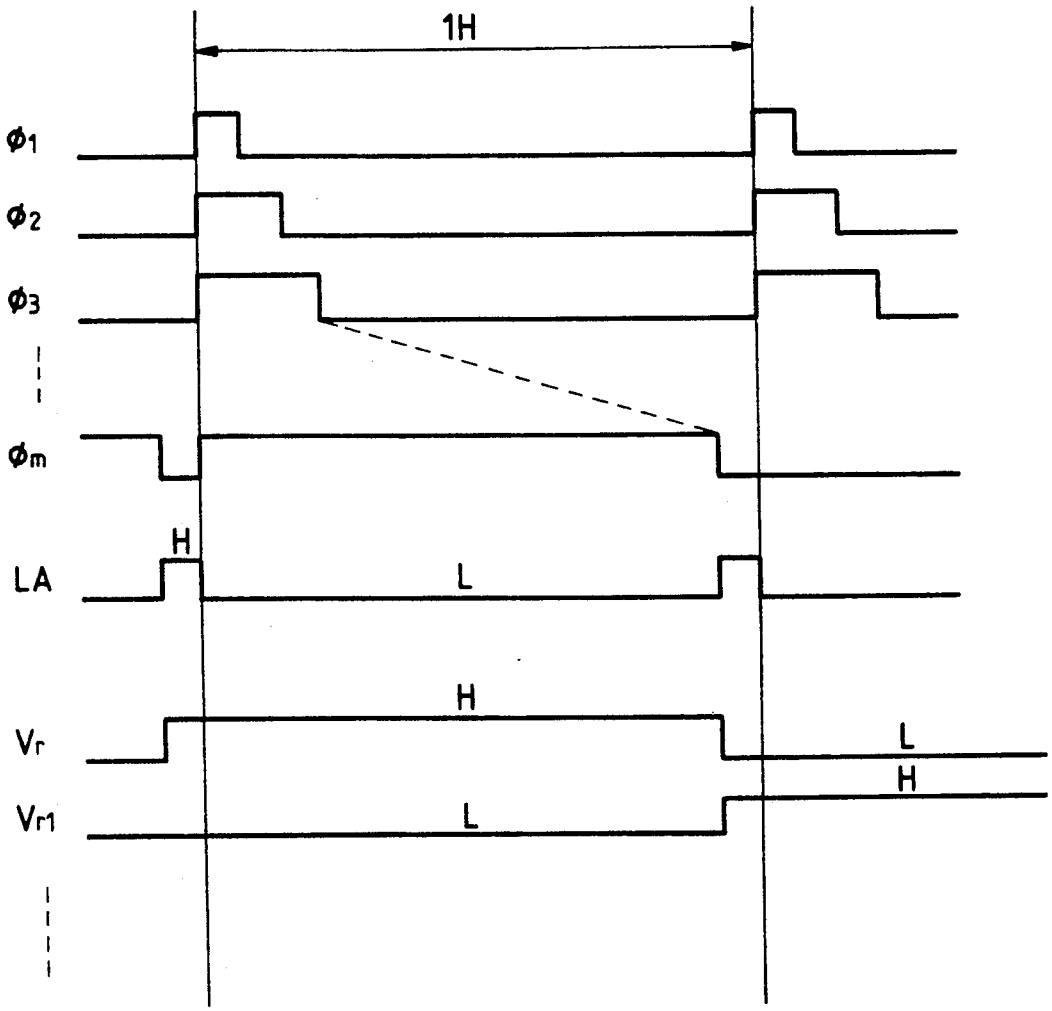
FIG. 19 shows an operation timing chart of the switch circuit in FIG. 18.

FIG. 19 is a timing chart that shows the operation of the display signal output circuit constructed with the switch circuit shown in FIG. 18(*a*).

As stated, in the embodiments of the present invention, as long as the initial state is defined, the control signals $\phi_1 \sim \phi_m$ to be incorporated are rendered to the other level by the timing of the clock signal thus, it is not necessary to provide a shift register. Also, in comparison with the operation with the shift register, the number of level shift timings of the control signal is further reduced.

As stated, the features of the present invention include signal lines 1*c* of m columns and scanning lines 1*b* of n rows, pixels 1*a* formed at the positions corresponding to the points of intersection of the signal lines and the scanning lines, a matrix circuit 1, which as a whole, consists of an $m \times n$ pixels, at least number of m voltage switching circuits 3*a* being arranged which has a voltage input terminal to which picture information signal Da is applied, a voltage output terminal that output signal Vc and a control terminal to which control signal $\phi$ is applied, the voltage output terminal of the voltage switching circuit 3*a* is connected with the signal line 1*c*, the voltage input terminals being independently connected to a number of K voltage input terminals ($K \geqq 1$, $K=1$ in FIG. 1, $K=3$ in FIG. 2, $K=6$ in FIG. 16) of the picture signal bus-line, at the same time, is constructed with a display signal output circuit 3 that incorporates and outputs the picture signal applied to the picture signal bus-line, with the timing of a control signal $\phi$ outputted to a control terminal, a display control circuit 4 that generates the control signal $\phi$, and a scanning circuit 2 to drive sequentially the matrix circuit 1 in the order according to lines, whereby the number of changes L of the voltage level of the control signal $\phi$, within one horizontal period of the picure signal, is minimized. The number L in FIG. 7 is two times.

The display device is further characterized in that, as in FIG. 8, after all of the control signals are set at approximately the same time to one voltage level, before incorporating the picture signal, the signals are sequentially changed to the other voltage level, and the picture signal is incorporated to the display signal output circuit. In this case, the ON state signal of the switch circuit that incorporates the picture signal becomes long one by one.

Either a P-Si or an a-Si thin film transistor may be used for the TFT in the present embodiments.

Because the TFT is used as a circuit component, the matrix circuit, the voltage switching circuit, the display signal output circuit, the display control circuit and the scanning circuit are formed on a same wafer.

Also, in comparison to the case where a shift register is used, the number of timings causing the ON and OFF operations of the switching circuit is reduced.

The present invention incorporates the display information signals at high speed by means of simple circuits, so that is especially suitable for a display apparatus that integrates the peripheral circuits and the display part. As a result, the miniaturization and simplification of the apparatus are achieved, such that a highly reliable display apparatus is realized.

Also, because the number of level changes of the control signal is minimized, the power consumption of the circuit is reduced, and a high integration of the circuit is effected without difficulty.

Further, the power supply circuit which generates the voltage to the circuit is further miniaturized.

What is claimed are:

1. A display device comprising:

matrix circuit including a plurality of signal lines defining a plurality of columns, a plurality of scanning lines intersecting said signal lines thereby defining a plurality of points of intersection, and a pixel set up at a position corresponding to one of the points of intersection of said signal lines and said scanning lines; and a plurality of switch circuits provided in correspondence to said signal lines, adapted to incorporate picture signals, and having an ON state and an OFF state, wherein the ON operating time of each said switch circuits is longer than the ON operating time for any of said switch circuits preceding it within the plurality of columns.

2. The display device according to claim 1, wherein the ON operating times of said switch circuits are initiated at substantially the same time.

3. A display device comprising:

a matrix circuit including a plurality of signal lines, a plurality of scanning lines intersecting said signal lines, and a plurality of pixels, each pixel set up at a position which corresponds to a point of intersection of one of said signal lines and one of said scanning lines;

a plurality of switch circuits corresponding to said signal lines and adapted to incorporate picture signals; and a display control circuit generating control signals to be supplied to said switch circuits, wherein said display control circuit controls said switch circuits such that said switch circuits are turned ON at substantially the same time and turned OFF in order.

4. The display device according to claim 3 wherein said switch circuit includes a timing control circuit controlling timing generation of an ON-OFF signal.

5. The display device according to claim 3, wherein said switch circuits are turned OFF in a predetermined time interval.

6. The display device according to claim 3, wherein said switch circuits are divided into a plurality of switch circuit groups each having a plurality of switch circuits and said display control circuit controls said plurality of switch circuits such that said switch circuits included in each of said switch circuit groups are turned OFF at substantially the same time.

7. A display device comprising:

a matrix circuit including a plurality of signal lines, a plurality of scanning lines intersecting said signal lines thereby defining a plurality of points of intersection, and a pixel set up at a position which corresponds to one of said plurality of points of intersection of said signal lines and said scanning lines; and a plurality of switch circuits corresponding to said signal lines and adapted to incorporate picture signals, wherein said plurality of switch circuits are turned ON at substantially the same time and turned OFF in order.

8. The display device according to claim 7, wherein said switch circuits are turned OFF in a predetermined time interval.

9. A display device comprising:

a matrix circuit including a plurality of signal lines, a plurality of scanning lines intersecting said signal lines, and a pixel set up at a position which corresponds to a point of intersection of said signal lines and said scanning lines;

a plurality of switch circuits for incorporating picture a signal provided corresponding to said signal lines; and a display control circuit generating control signals to be supplied to said switch circuits, wherein, within a period for selecting each said scanning lines, after setting all of said control signals at approximately the same time to a first voltage level, each of the control signals is sequentially changed at every constant time tH to a second voltage level in the period for selecting each of said scanning lines.

10. The display device according to claim 9, wherein said display control circuit at least inputs a first timing signal for setting all of said control signals approximately at the same time to one voltage level and a second periodic timing signal for changing each of the control signals to the other voltage level sequentially at every constant time tH.

11. A display method of a display device comprising:

a matrix circuit including a plurality of signal lines, a plurality of scanning lines intersecting said signal lines, and a pixel set up at a position which corresponds to a point of intersection of said signal lines and said scanning lines; and a plurality of switch circuits corresponding to said signal lines and adapted to incorporate picture signals, wherein said switch circuits are turned ON at substantially the same time and turned OFF in order.

12. A display method of a display device according to claim 11, wherein said switch circuits are turned OFF in a predetermined time interval.

13. A display device comprising:

a matrix circuit including m columns of signal lines, n rows of scanning lines, each scanning line intersecting said m columns of signal lines, and $m \times n$ pixels located at positions corresponding to points of intersection of said signal lines and said scanning lines;

a display signal output circuit including m switch circuits, each of which include a voltage input terminal connected to at least one of a plurality of information signal lines, a voltage output terminal connected to one of said signal lines and a control terminal, and having an ON state and an OFF state depending on one of a plurality of control signals input to said control terminal;

a display control circuit generating said control signals; and a scanning circuit sequentially driving said matrix circuit one scanning line at a time, wherein said switch circuits are turned ON at substantially the same time and turned OFF in order.

14. The display device according to claim 13, wherein each of the pixels includes a thin film transistor and a liquid crystal.

15. The display device according to claim 13, wherein said matrix circuit, said display signal output circuit, said display control circuit, and said scanning circuit are formed on a same substrate.

16. The display device according to claim 13, wherein said switch circuits are divided into a plurality of switch circuit groups each having a plurality of switch circuits and the switch circuits included in each of said switch circuit groups are turned OFF at substantially the same time.

17. A display device comprising:

a matrix circuit including a plurality of signal lines defining a plurality of columns, a plurality of scanning lines intersecting said signal lines thereby defining a plurality of points of intersection, and a pixel set up at a position corresponding to one of the points of intersection of said signal lines and said scanning lines; and a plurality of switch circuit groups each having a plurality of switch circuits each provided in correspondence to said signal lines, adapted to incorporate picture signals, and each having an ON state and an OFF state, wherein the ON operating times of the switch circuits included in each said switch circuit groups are longer than the ON operating times for the switch circuits in any of said switch circuit groups preceding it within the plurality of columns.

* * * * *

UNITED STATES PATENT AND TRADEMARK OFFICE

CERTIFICATE OF CORRECTION

PATENT NO. : 5,287,095

DATED : February 15, 1994

INVENTOR(S) : Masaaki Kitazima, et al

It is certified that error appears in the above-indentified patent and that said Letters Patent is hereby corrected as shown below:

| Column | Line | |
|---|---|---|
| 1 | 47 | Change "build-in" to --builds-in--. |
| 2 | 10 | After "minimized" insert --,--. |
| 2 | 46 | After "fashion" insert --,--. |
| 3 | 38 | Change "2(a)" to --2(b)--. |
| 4 | 2 | After "voltage" delete ")". |
| 4 | 3 | After "1g" insert --)--. |
| 6 | 17 | Change "First" to --first--. |
| 6 | 18 | Change "$\phi_2$" to --$\phi_1$--. |
| 7 | 15 | Change "thus" to --Thus--. |

Signed and Sealed this

Twenty-sixth Day of July, 1994

Bruce Lehman

*Attest:*

BRUCE LEHMAN

*Attesting Officer*

*Commissioner of Patents and Trademarks*